US006918859B1

(12) United States Patent
Yeh

(10) Patent No.: US 6,918,859 B1
(45) Date of Patent: Jul. 19, 2005

(54) DYNAMIC SOLE-MASSAGING MACHINE WITH MUTIPLE FUNCTIONS OF JOINTS SOOTHING AND BLOOD CIRCULATION STIMULATING

(76) Inventor: Don-Lon Yeh, 7Fl-3, 144, San Min Rd., Sec. 3, Taichung (TW)

( * ) Notice: Subject to any disclaimer, the term of this patent is extended or adjusted under 35 U.S.C. 154(b) by 0 days.

(21) Appl. No.: 10/350,073

(22) Filed: Jan. 24, 2003

(51) Int. Cl.[7] ..... A63B 21/00
(52) U.S. Cl. ..... 482/54
(58) Field of Search ..... 601/1, 23, 28, 601/71, 132, 143; 482/54, 51–53, 57–65

(56) References Cited

U.S. PATENT DOCUMENTS 4,204,673 A * 5/1980 Speer, Sr. ..... 482/5
4,925,183 A * 5/1990 Kim ..... 482/61
5,527,241 A * 6/1996 Peng ..... 482/54
6,027,432 A * 2/2000 Cheng ..... 482/57
6,077,201 A * 6/2000 Cheng ..... 482/57
6,511,404 B2 * 1/2003 Tu ..... 482/57
6,663,540 B1 * 12/2003 Huang ..... 482/54

* cited by examiner

*Primary Examiner*—Stephen R. Crow
(74) *Attorney, Agent, or Firm*—Dennison, Schultz, Dougherty & MacDonald

(57) ABSTRACT

A treadmill having a messaging machine for massaging and soothing joints and feet and for providing blood circulation is disclosed having a support frame adjustably mounted a roller on front and rear portions of the frame, a treadmill belt installed outside the two rollers in an encircling configuration, a motor, a number of massaging knobs of varying heights on an upper surface of the support frame, wherein the soles of a user's feet can be massaged according to the variable positions of the messaging knobs.

2 Claims, 9 Drawing Sheets

Fig • 1

PRIOR ART

Fig • 2
PRIOR ART

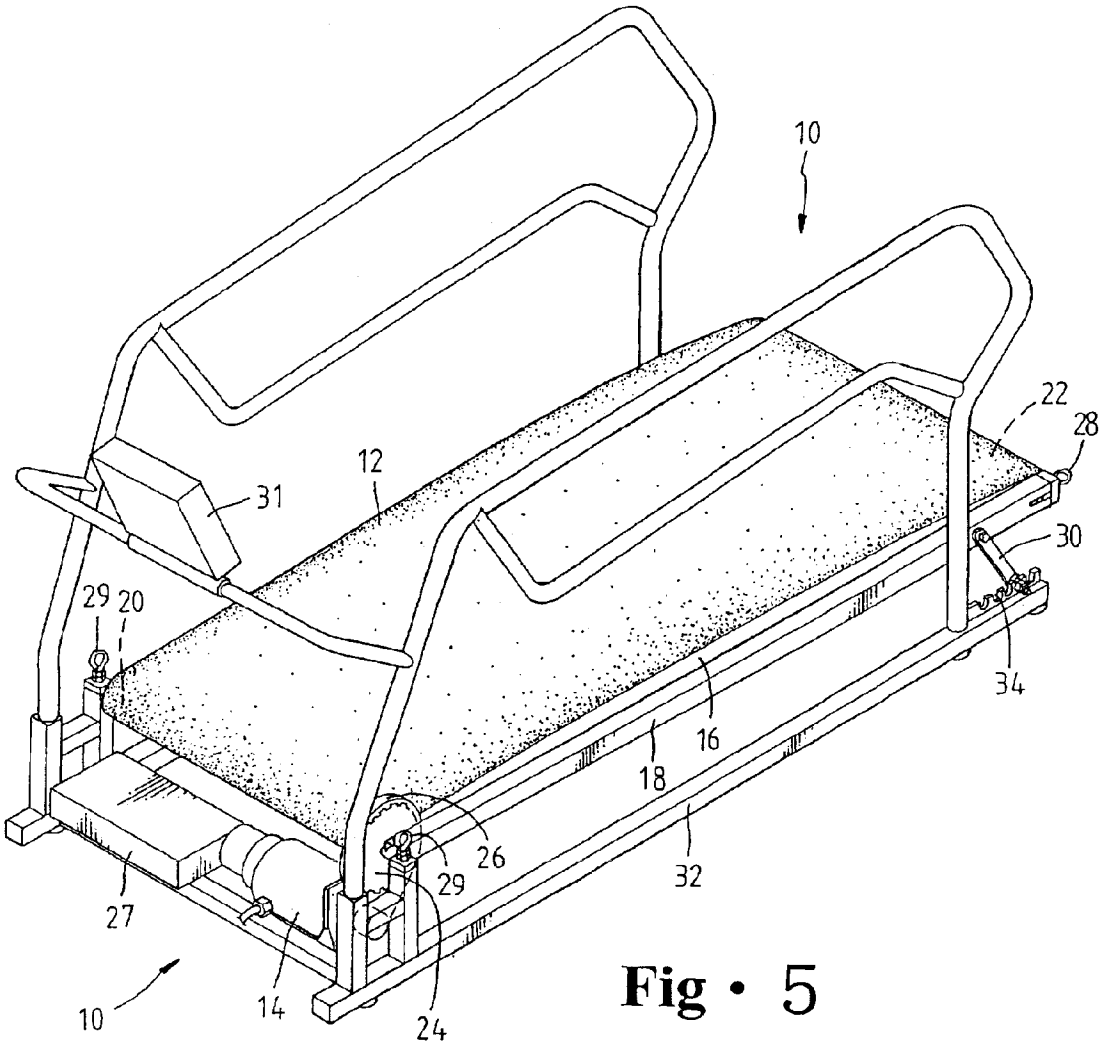
Fig • 5

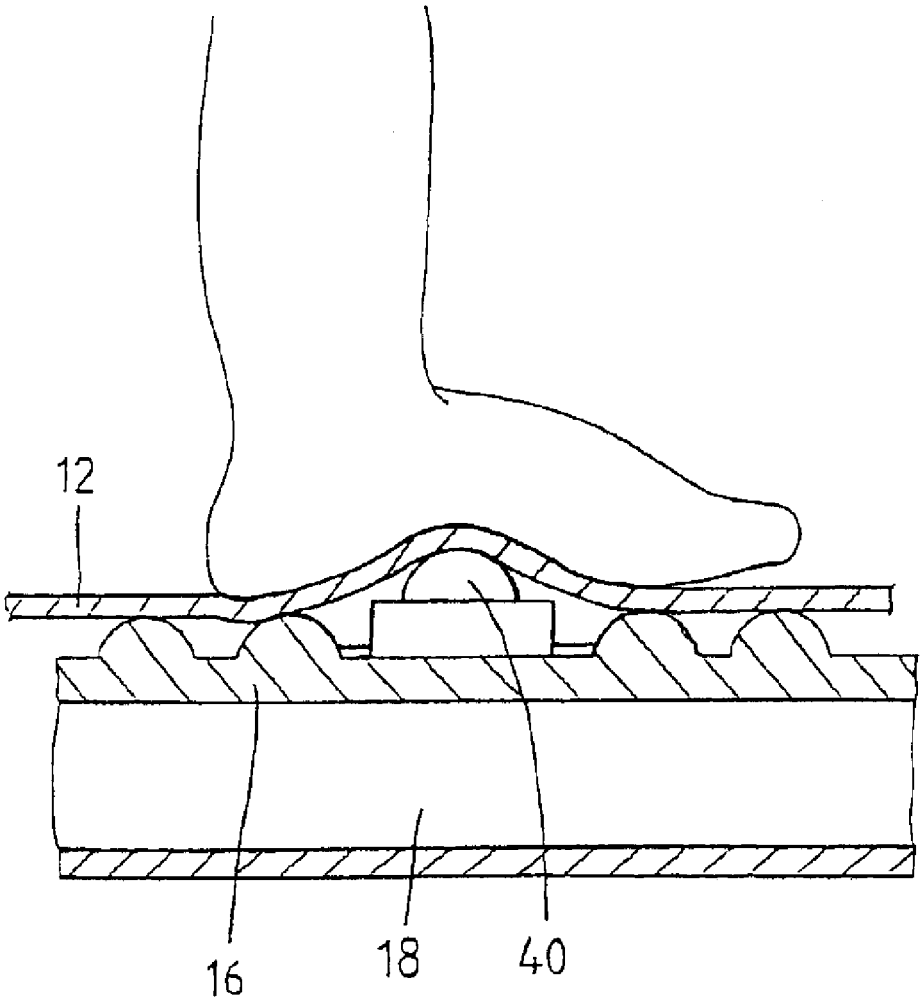
Fig • 6

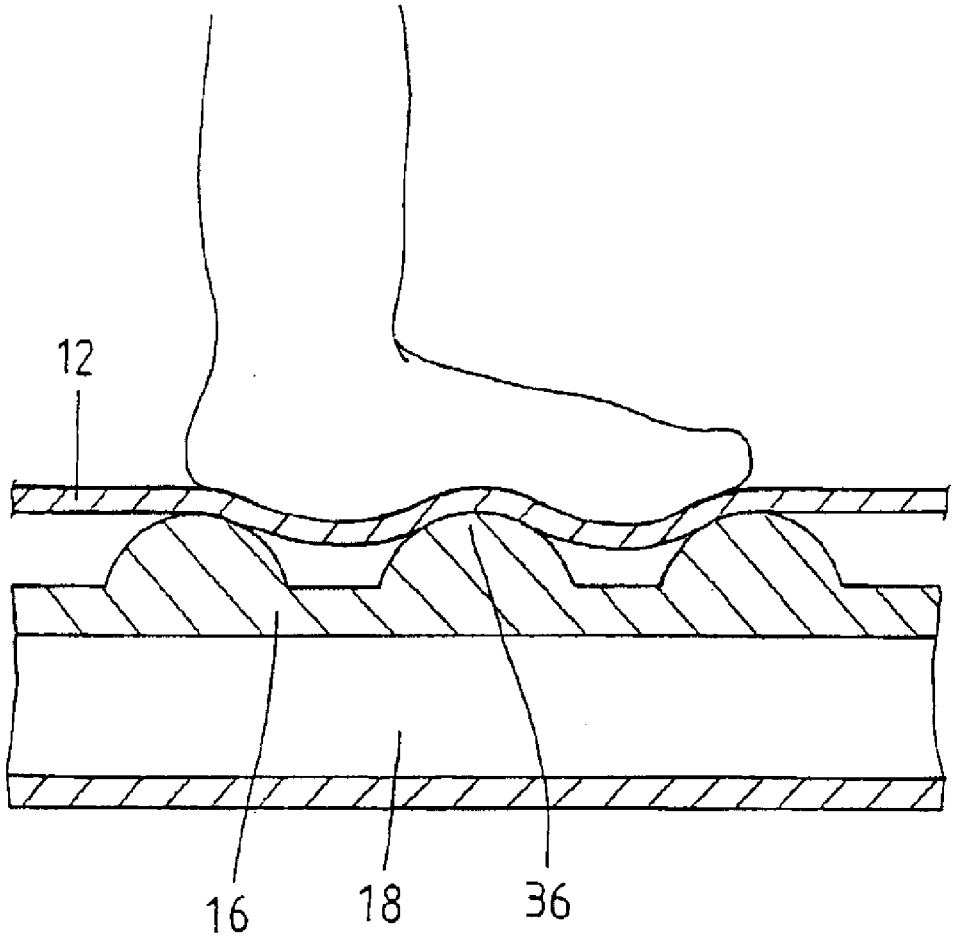
Fig • 7

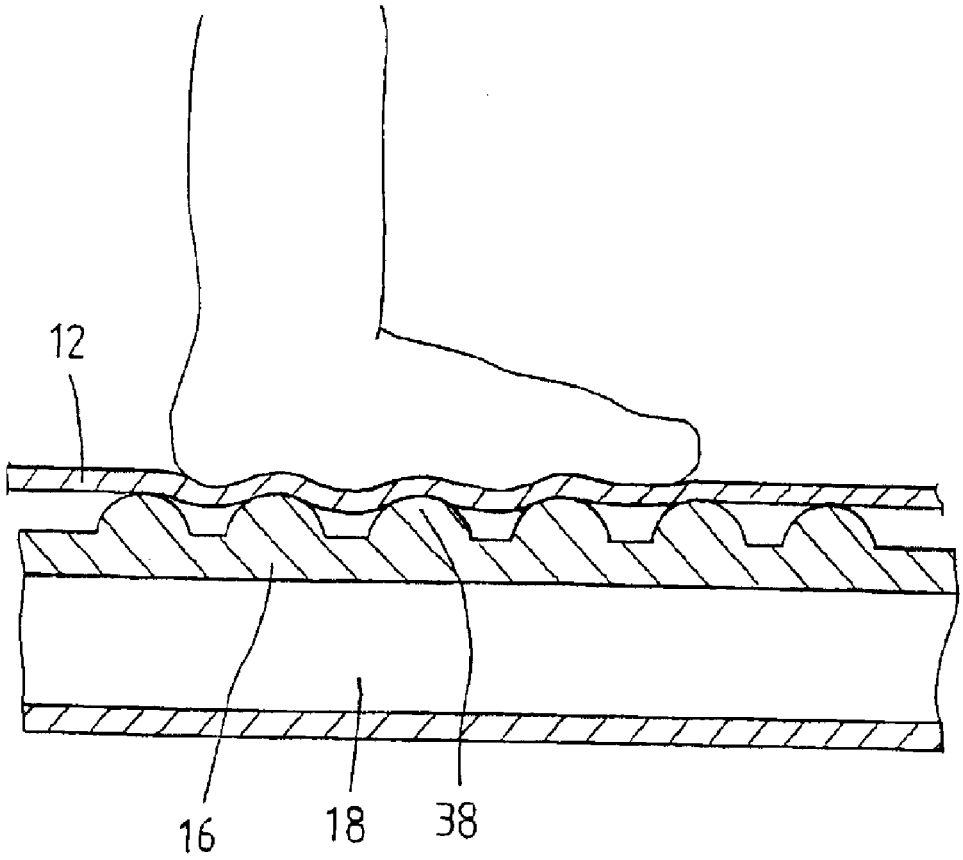
Fig • 8

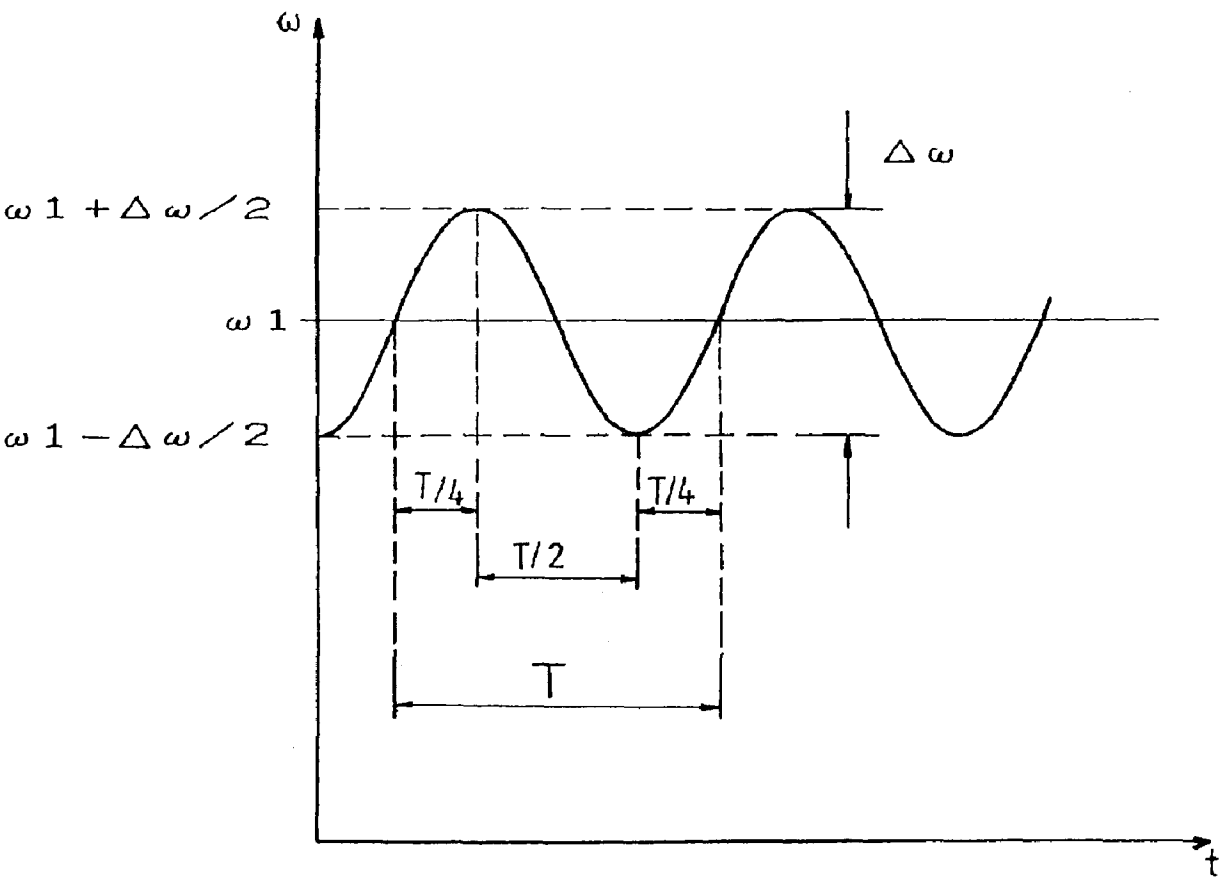
Fig • 9

DYNAMIC SOLE-MASSAGING MACHINE WITH MUTIPLE FUNCTIONS OF JOINTS SOOTHING AND BLOOD CIRCULATION STIMULATING

BACKGROUND OF THE INVENTION

The present invention relates generally to an exercise and relaxation machine, and more particularly to a dynamic machine designed to massage soles, and indirectly cause massage functions of stimulation to the internal organs as well as to soothe joints and stimulate the blood circulation.

After a certain development of social economy, leisure and sports have become in people's living. In consideration for those who are aged, crippled, blind or disable cannot move and exercise properly, they can be assisted by some equipments to perform some easy exercises to avoid muscles recession and degeneration of internal organs. Now there are not enough rooms and spaces for physical cure in the hospitals and the equipments are all designed to recover the functions of limbs after they are injured. We all know that precaution is prior to cure, it has become essential and necessary for the family if there are physical equipments which can objectives of precaution and cure. The invention arises from the above concepts. In conclusion, there are quite developing area to explore in a gym as well as there are huge requirements for sporting equipments.

SUMMARY OF THE INVENTION

The present invention comprises a sole-massaging machine, a track, a motor, and a motor controller, and a massage plate. The sole-massaging machine comprises a base on which a support frame is adjustably mounted and two rollers are mounted on the support frame to drive a track. The base is provided in one portion of the upper surface with a number of knobs of varying heights and smooth curve. Also, a second portion of the upper side is provided with a number of massaging knobs with sharper and high density and, in both sides of the upper side are provided with taller and sharper knobs. A roller and a shaft is disposed in the front and at the back of the support frame. One of the two rollers is driven by a motor in conjunction with a controller for adding a variable amplitude and frequency to the motor in a stable motion. In this way, the massaging knobs massage the soles of a user's feet once the user steps on the treadmill belt. Meanwhile, the motor can be commanded by the controller to generate proper vibration. While the user is walking on the massaging knobs, the joints of the sole are affected by the knobs and generate effects of moving. While, the user is walking on less sharp and intensive knobs, the sole shall be continuously stimulated. While both feet of the user are on bigger and taller knobs and the motor controller only generate vibration with different frequency in the same motion, the parts that the sole touches the knobs shall feel stronger effects of massaging. Meanwhile, the whole body and the internal organs shall feel vibrating massaging in different extent, which can accelerate the blood circulation of the whole body just like the effects after people has finished doing exercises.

BRIEF DESCRIPTION OF THE DRAWINGS

FIG. 5 shows a perspective view of the preferred embodiment of the present invention.

FIGS. 6–8 are schematic views of the preferred embodiment of the present invention at work.

FIG. 9 shows a diagram of the variable speed of the motor of the preferred embodiment of the present invention.

DESCRIPTION OF THE INVENTION

Figure 1:
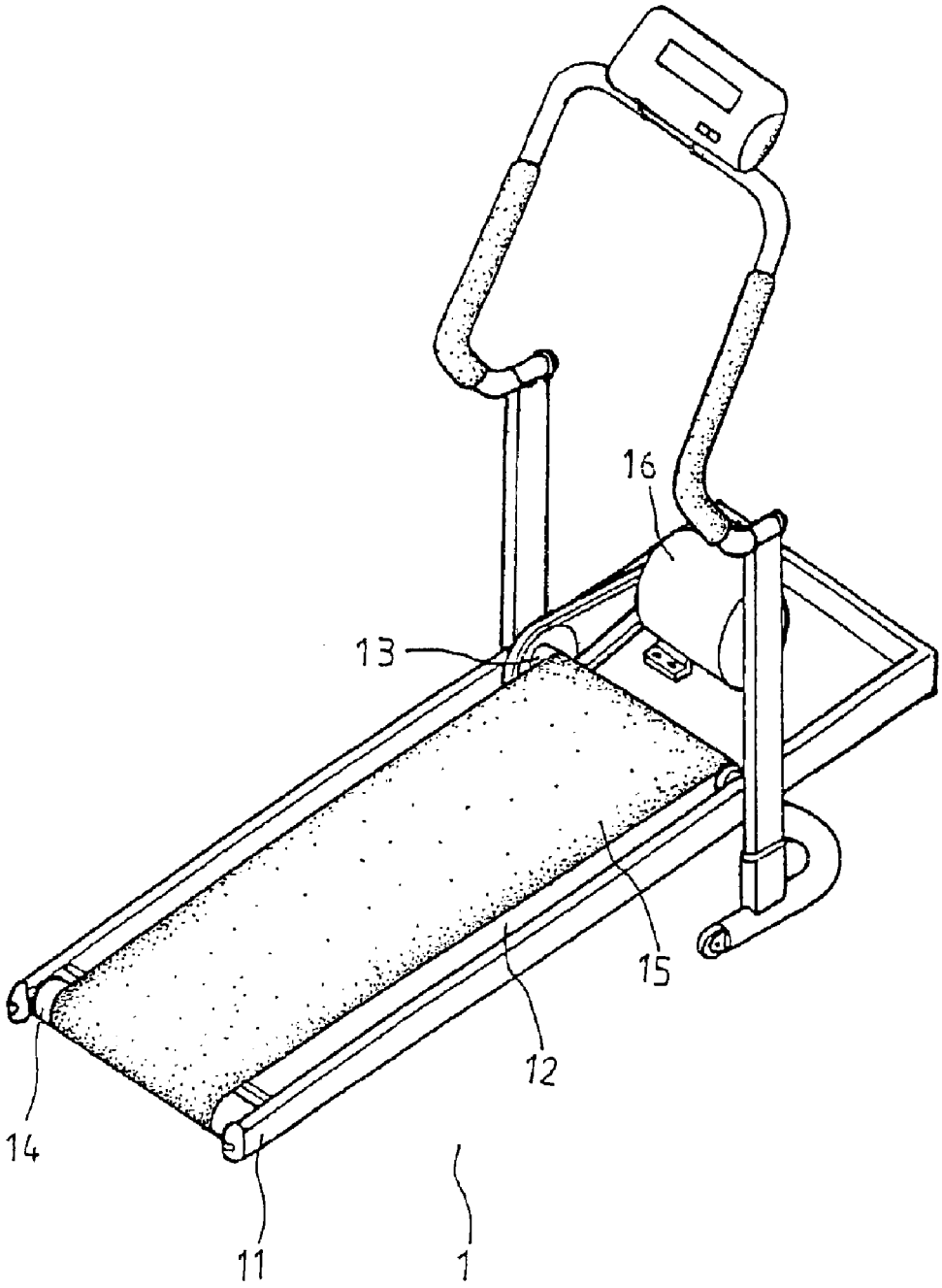
FIG. 1 shows a perspective view of a treadmill of the prior art.
Figure 2:
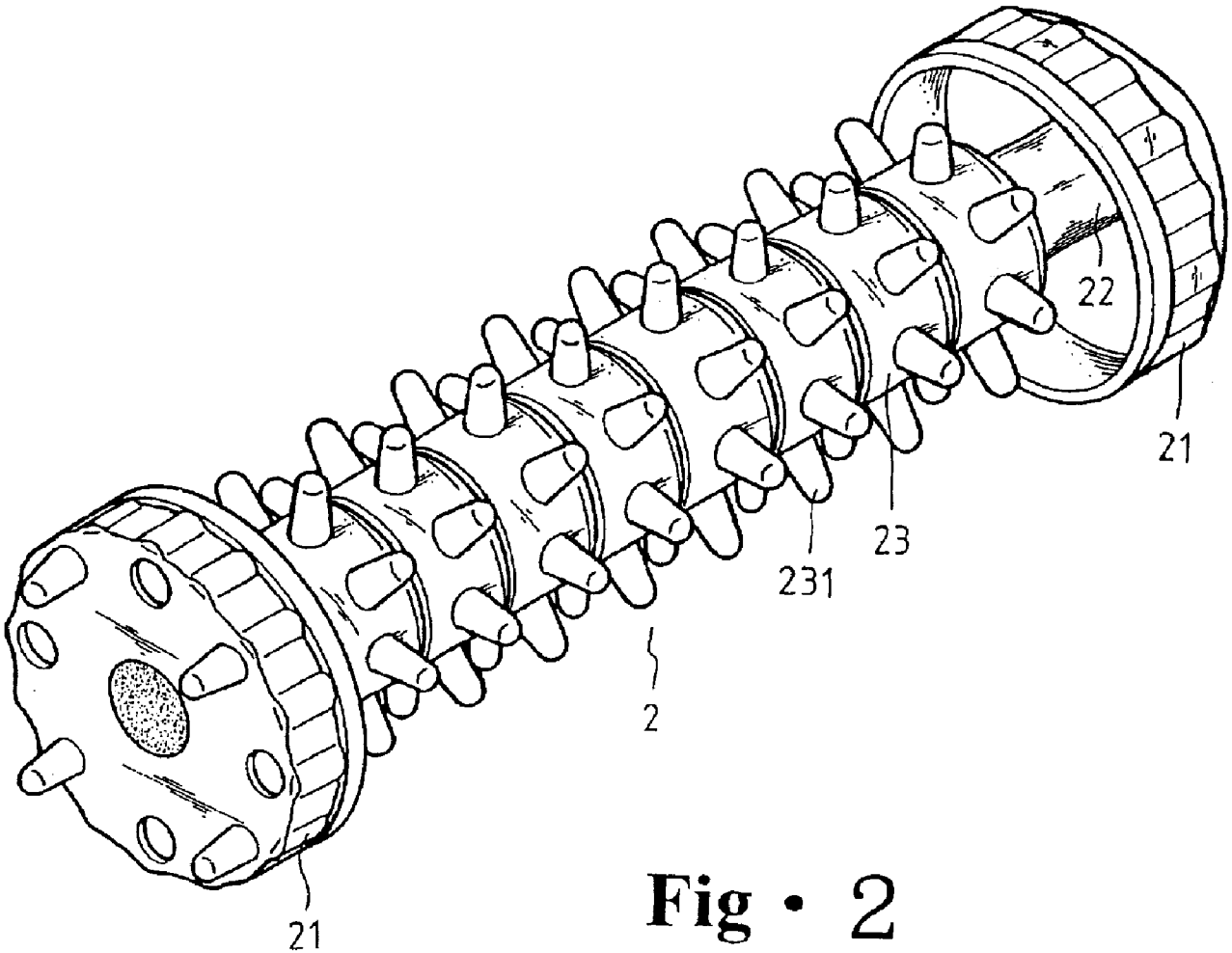
FIG. 2 shows a perspective view of a sole-massaging device of the prior art.

The primary objectives of the present invention not only provide functions of walking and jogging on a treadmill but also provide a sole-massaging machine capable of massaging soles in various intensities so as to soothe joints and stimulate blood circulation. The foregoing objective of the present invention is attained by a sole-massaging machine comprising a base on which a support frame is mounted. A massage plate is mounted on the support frame and is situated under a track which is driven by two rollers mounted at two longitudinal ends of the support frame. The rollers are driven by a motor in conjunction with a controller which is used to regulate the operation of the motor. The massage plate includes an upper surface having a number of massaging knobs of various sizes disposed thereon. The massaging knobs come in contact with the underside of the track when a user steps on the track and exerts weight pressure from the soles of their feet. The massaging knobs bring about the massaging effect various intensities in conjunction with the vibration of the track at various frequencies. Meanwhile, aged or crippled people can gradually recover and become healthy by exercising with the use of the invention, which is regarded as dual functions of precaution and cure in medication.

The primary objective of the present invention is to provide a sole-massaging machine capable of massaging soles in various intensities so as to soothe joints and stimulate blood circulation. The features, functions, and advantages of the present invention will be more readily understood upon a thoughtful deliberation of the following detailed description of a preferred embodiment of the present invention with reference to the accompanying drawings.

As shown in FIGS. 3–8, a sole massaging machine 10 embodiment in the present invention comprises a base 32, a support frame 18, a massage plate 16, a track 12, a motor 14, and a motor controller 27.

The support frame 18 is adjustably mounted on the base 32 by a plurality of adjustment bolts 29 in conjunction with an adjustment rod 30 disposed downwardly in a locating slot 34. The support frame 18 can be therefore located at an inclination. Two rollers 20 and 22 are mounted respectively at two longitudinal ends of the support frame 18. The track 12 runs on the two rollers 20 and 22. The roller 20 is driven by the motor 14 in conjunction with a transmission wheel 24 and a transmission belt 26. The operation of the motor 14 is regulated by the controller 27. The rear roller 22 can be adjusted by an adjustment bolt 28 for adjusting the distance between the front roller 20 and the rear roller 22. As a result, the tightness of the track 12 can be adjusted.

Figure 3:
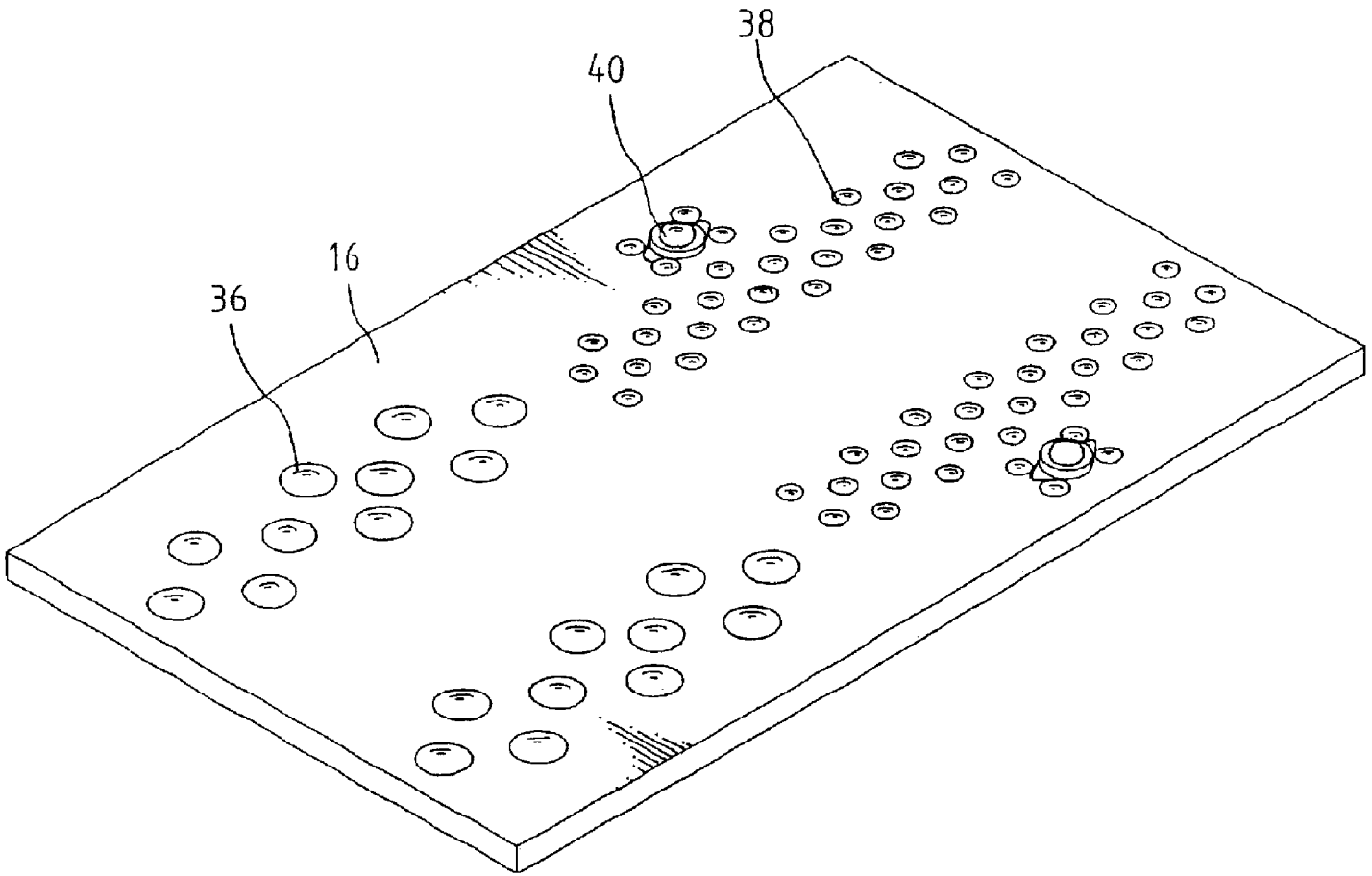
FIG. 3 shows a perspective view of the massage plate of the preferred embodiment of the present invention.
Figure 4:
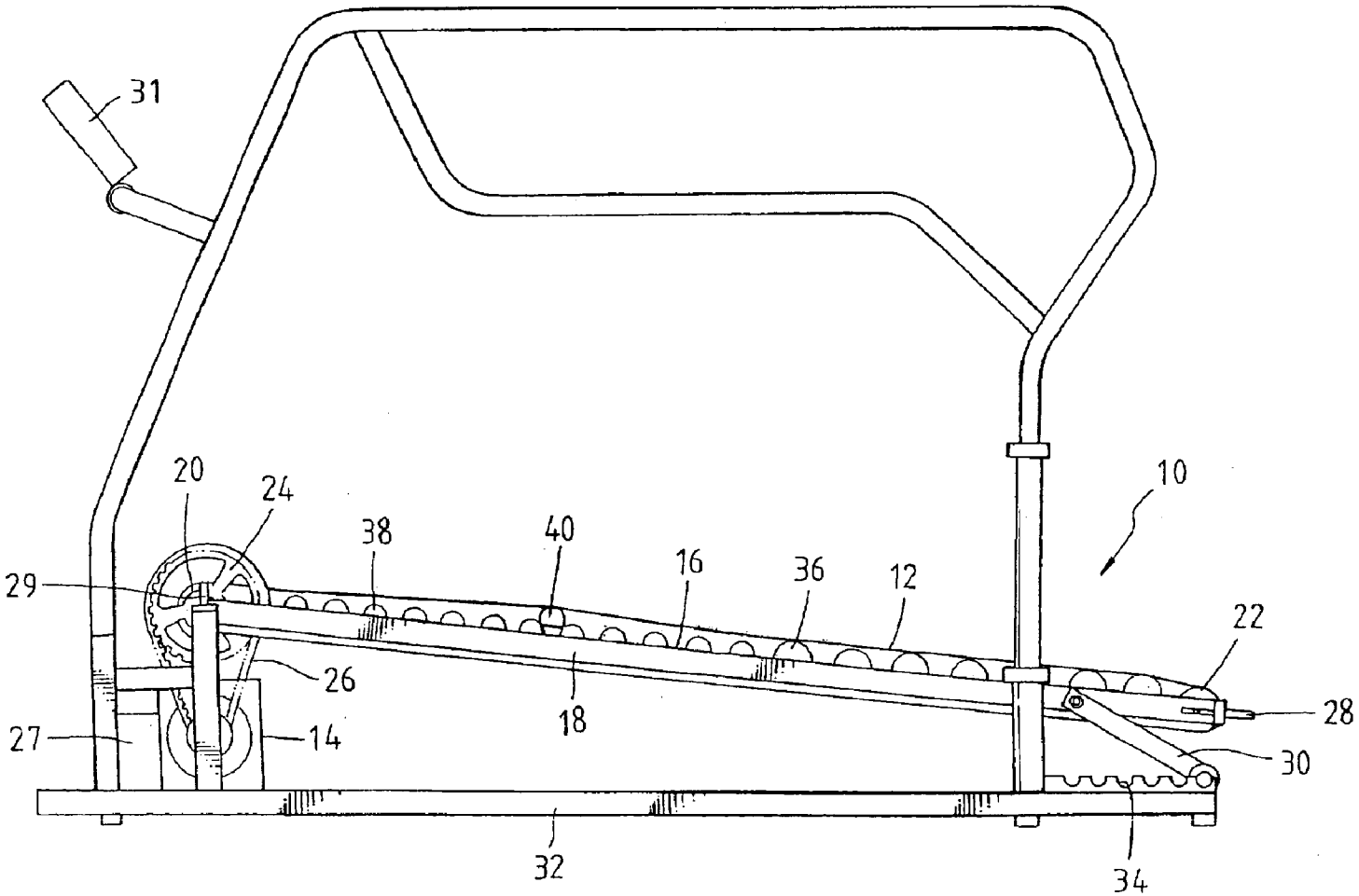
FIG. 4 shows a side schematic view of the preferred embodiment of the present invention.

The massage plate 16 is located under the track 12 and includes an upper surface having a number of knobs 36, 38 and 40. The knobs 36 are relatively larger in dimension and have a flat top. The knobs 36 are sparsely distributed. The knobs 38 are smaller in dimension than the knobs 36 and are provided with a tapered top. The knobs 40 are relatively larger in height than the knobs 36 and 38. It must be noted that the knobs 36 are distributed on one portion of the upper surface of the massage plate 16, whereas the knobs 38 are distributed on a second portion of the upper surface of the massage plate 16, whereas the knobs 38 are distributed on a third portion of the upper surface of the massage plate 16. The knobs 40 are distributed on the marginal areas of the upper surface of the massage plate 16, as shown in FIG. 3.

As illustrated in FIGS. 6, 7, and 8, when a person walks or trot on the track 12, the underside of the track 12 comes in contact with the knobs 36, 38, and 40, thereby resulting in an massaging effect on the soles of the person. In addition, the operation of the motor 14 is regulated by the controller 27 in such a way the track 12 can be caused to shiver so as to enhance the massaging effect.

Now referring to FIG. 9, "T" stands for a period, while $\Delta\omega$ stands for a modulated speed amplitude which is added to an average speed $\omega 1$ by the controller 27.

The motor 14 and the track 12 are stationary when the average speed $\omega 1=0$; $\Delta\omega\neq 0$. As a result the knobs 36, 38 and 40 of the massage plate 16 bring about a static massage.

The motor 14 is in motion by means of the speed amplitude $\Delta\omega$ at the time when the average speed $\omega 1=0$; $\Delta\omega\neq 0$. As a result, the motor 14 is in a forward motion at T/2 and is in a reverse motion at another T/2, thereby resulting in the running of the track 12. In light of the period "T" being extremely small, the track 12 is caused to shiver at the very moment of its abrupt movement. Such a vibrating effect is imparted to the body via the soles of a person standing on the track 12. As the speed amplitude is modulated, a massaging effect of an intensity is brought about.

As shown in FIG. 6, the sole is massaged by the knob 40 such that its massaging intensity is dependent on the body weight of the person as well as the distribution of center of gravity of the legs of the person. The heat generated by the friction between the contact point and the track 12 in high speed motion can be reduced by massaging with the knobs 40, which are designated as heat-relief knob.

As the average speed $\omega 1\neq 0$; $\Delta\omega=0$, the motor 14 is in a stable motion in one direction, thereby resulting in a stable motion of the track 12. The speed of the track 12 in motion can be regulated by adjusting the magnitude of $\omega 1$. The soles are massaged by the knobs which are in motion in a direction from heel toward toes.

As illustrated in FIG. 7, when the legs move backward, the joints are soothed by the massaging effect of the knobs 36. The knobs are thus designed as joint-soothing knobs.

As shown in FIG. 9, the knobs 38 are smaller and sharper so the internal organs of the user will be entirely stimulated through the reflective parts of the points of the sole of the feet while stepping on the massaging knobs 38.

When the average speed $\omega 1\neq 0$; $\Delta\omega=0$, the motor 14 is in motion in one direction. In light of the influence of an added speed amplitude $\Delta\omega$, the motor 14 is accelerated from the average speed $\omega 1$ to $\omega 1+\Delta\omega 2$ at the outset T/4 of the period T. Subsequently, the speed is reduced from $\omega 1+\Delta\omega/2$ to $\omega 1-\Delta\omega 2$ at T/2. The speed is finally increase to $\omega 1$ at ¼T. In light of the period T being extremely small, the track 12 is actuated by the motor 14 at various speeds in a period T, there causing the track 12 to shiver to bring about the massage effect on the body of the user of the machine.

The embodiment of the present invention described above is to be regard in all respects as being illustrative and nonrestrictive. Accordingly, the present invention may be embodied in order specific forms without deviating from the spirit thereof. The embodiment of the present invention described above is to be regard in all respects as being illustrative and nonrestrictive. Its purposes and functions are stated as follows:

1. The activation of the joints of the feet: to gain the effects of activating the joints of the fee by using and stepping on the larger and smoother massaging knobs. 2. The stimulation of the sole of the feet: Entirely stimulating the sole of the feet by using and stepping on the smaller and higher intensive knobs, which make one feel like walking on tiny and sharp stones. 3. The stimulation of the points areas of the sole of the feet: to gain the effects of massaging the points of the: sole of the feet by using and stepping on higher and sharper rolling beads. The stimulating reactions are outstanding. 4. The massaging of internal organs and the joints of the whole body: in accordance with the weight of the user, under the condition of lower frequency and higher vibration, it can activate and shake the internal organs and joints of the whole body, which make one feel like walking, and it will not cause any exercise injuries. 5. The better blood circulation of the whole body; under the condition of higher frequency and lower vibration, one can gain the effects of the better blood circulation of the whole body. 6. The above functions can be created simultaneously on the invention and the effects are synergistic. It does not take much spaces and it matches the trend of using light and compact things nowadays.

What is claimed is:

1. A massaging apparatus, comprising:

a support frame having a first end and a second end, a first roller supported on a first shaft at said first end and a second roller supported on a second shaft as said second end, a treadmill belt encircling around said first roller and said second roller, a motor having a shaft, a motor controller providing a variable amplitude and frequency to said motor, said motor shaft operably connected to said first roller, and, a cluster of knobs comprising a central knob surrounded by a plurality of smaller knobs, said cluster of knobs disposed on an upper surface of said support frame, wherein said treadmill belt is driven over said plurality of knobs.

2. The massaging apparatus of claim 1, wherein said cluster of knobs further comprises a first plurality of knobs having a first height and a second plurality of knobs having a second height, wherein said first height of said first plurality, of knobs is longer than said second height of said second plurality of knobs.

* * * * *